US006892829B2

(12) United States Patent
Livingstone

(10) Patent No.: US 6,892,829 B2
(45) Date of Patent: May 17, 2005

(54) TWO STRING DRILLING SYSTEM

(75) Inventor: James I. Livingstone, Calgary (CA)

(73) Assignee: PressSol Ltd., Alberta (CA)

( * ) Notice: Subject to any disclaimer, the term of this patent is extended or adjusted under 35 U.S.C. 154(b) by 16 days.

(21) Appl. No.: 10/346,125

(22) Filed: Jan. 17, 2003

(65) Prior Publication Data

US 2003/0173088 A1 Sep. 18, 2003

Related U.S. Application Data

(60) Provisional application No. 60/348,611, filed on Jan. 17, 2002.

(51) Int. Cl.[7] ..... E21B 17/18; E21B 21/12

(52) U.S. Cl. ..... 175/57; 175/213; 175/215; 175/296; 175/321

(58) Field of Search ..... 175/215, 213, 175/321, 324, 296, 57

(56) References Cited

U.S. PATENT DOCUMENTS

| | | | | |
|---|---|---|---|---|
| 2,609,836 A | | 9/1952 | Knox | |
| 2,849,213 A | * | 8/1958 | Failing | 175/213 |
| 3,075,589 A | | 1/1963 | Grable et al. | |
| 3,416,618 A | | 12/1968 | Kunnemann | |
| 3,770,006 A | | 11/1973 | Sexton et al. | |
| 3,792,429 A | | 2/1974 | Patton et al. | |
| 3,795,283 A | | 3/1974 | Oughton | |
| 3,920,090 A | | 11/1975 | McQueen et al. | |
| 4,055,224 A | | 10/1977 | Wallers | |
| 4,100,528 A | | 7/1978 | Bernard et al. | |
| 4,219,087 A | | 8/1980 | Johnson | |
| 4,243,252 A | | 1/1981 | Johnson | |
| 4,321,974 A | | 3/1982 | Klemm | |
| 4,391,328 A | | 7/1983 | Aumann | |
| 4,431,069 A | | 2/1984 | Dickinson, III et al. | |
| 4,461,448 A | | 7/1984 | Huey et al. | |
| 4,463,814 A | | 8/1984 | Horstmeyer et al. | |
| 4,509,606 A | | 4/1985 | Willis | |
| 4,534,426 A | | 8/1985 | Hooper | |
| 4,647,002 A | | 3/1987 | Crutchfield | |
| 4,671,359 A | | 6/1987 | Renfro | |
| 4,681,164 A | | 7/1987 | Stacks | |
| 4,682,661 A | * | 7/1987 | Hughes et al. | 175/215 |
| 4,705,119 A | | 11/1987 | Kostylev et al. | |
| 4,709,768 A | | 12/1987 | Kostylev et al. | |
| 4,718,503 A | * | 1/1988 | Stewart | 175/70 |
| 4,739,844 A | | 4/1988 | Farris et al. | |
| 4,744,420 A | | 5/1988 | Patterson et al. | |
| 4,790,391 A | | 12/1988 | Hamamura et al. | |
| 4,832,126 A | | 5/1989 | Roche | |

(Continued)

FOREIGN PATENT DOCUMENTS

| | | |
|---|---|---|
| CA | 1325969 | 10/1987 |
| EP | 0787886 | 5/1997 |

(Continued)

OTHER PUBLICATIONS

U.S. Appl. No. 10/622,582 to Livingstone, filed Jul. 21, 2003.*

(Continued)

*Primary Examiner*—David Bagnell
*Assistant Examiner*—Giovanna Collins
(74) *Attorney, Agent, or Firm*—Bennett Jones LLP

(57) ABSTRACT

Method and apparatus for drilling a well bore in a hydrocarbon formation using concentric drill string having an inner pipe and an outer pipe defining an annulus there between. A drilling means such as an air hammer or a rotary drill bit and driving system is provide at the lower end of the concentric drill string and drilling medium is delivered through the annulus or inner pipe for operating the drilling means to form a borehole. Drilling medium, drilling cutting and hydrocarbon are removed from the well bore by extracting the drilling medium, drilling cutting and hydrocarbon through the other of the annulus or inner pipe.

40 Claims, 9 Drawing Sheets

U.S. PATENT DOCUMENTS

| | | | | | |
|---|---|---|---|---|---|
| 5,006,046 | A | | 4/1991 | Buckman et al. | |
| 5,020,611 | A | | 6/1991 | Morgan et al. | |
| 5,033,545 | A | | 7/1991 | Sudol | |
| 5,068,842 | A | | 11/1991 | Naito | |
| 5,174,394 | A | | 12/1992 | Fischer et al. | |
| 5,178,223 | A | * | 1/1993 | Smet | 175/424 |
| 5,199,515 | A | * | 4/1993 | Sinclair et al. | 175/213 |
| 5,236,036 | A | | 8/1993 | Ungemach et al. | |
| 5,285,204 | A | | 2/1994 | Sas-Jaworsky | |
| 5,348,097 | A | | 9/1994 | Giannesini et al. | |
| 5,396,966 | A | | 3/1995 | Roos, Jr. et al. | |
| 5,411,105 | A | | 5/1995 | Gray | |
| 5,435,395 | A | | 7/1995 | Connell | |
| 5,513,528 | A | | 5/1996 | Holenka et al. | |
| 5,575,451 | A | | 11/1996 | Colvin et al. | |
| 5,638,904 | A | | 6/1997 | Misselbrook et al. | |
| 5,720,356 | A | | 2/1998 | Gardes | |
| 5,881,813 | A | | 3/1999 | Brannon et al. | |
| 5,890,540 | A | | 4/1999 | Pia et al. | |
| 5,892,460 | A | | 4/1999 | Jerabek et al. | |
| 6,015,015 | A | | 1/2000 | Luft et al. | |
| 6,047,784 | A | | 4/2000 | Dorel | |
| 6,065,550 | A | | 5/2000 | Gardes | |
| 6,109,370 | A | | 8/2000 | Gray | |
| 6,158,531 | A | | 12/2000 | Vail, III | |
| 6,189,617 | B1 | | 2/2001 | Sorhus et al. | |
| 6,192,985 | B1 | | 2/2001 | Hinkel et al. | |
| 6,196,336 | B1 | | 3/2001 | Fincher et al. | |
| 6,209,663 | B1 | | 4/2001 | Hosie | |
| 6,209,665 | B1 | | 4/2001 | Holte | |
| 6,213,201 | B1 | | 4/2001 | Renkis | |
| 6,250,383 | B1 | | 6/2001 | Patel | |
| 6,263,987 | B1 | | 7/2001 | Vail, III | |
| 6,325,159 | B1 | | 12/2001 | Peterman et al. | |
| 6,359,438 | B1 | | 3/2002 | Bittar | |
| 6,377,050 | B1 | | 4/2002 | Chemali et al. | |
| 6,394,197 | B1 | | 5/2002 | Holte | |
| 6,405,809 | B2 | | 6/2002 | Patel et al. | |
| 6,481,501 | B2 | | 11/2002 | Chavez et al. | |
| 2002/0000332 | A1 | | 1/2002 | Merecka et al. | |
| 2003/0141111 | A1 | | 7/2003 | Pia | |
| 2003/0150621 | A1 | | 8/2003 | Pia | |
| 2003/0155156 | A1 | * | 8/2003 | Livingstone | 175/57 |
| 2004/0079553 | A1 | * | 4/2004 | Livingstone | 175/61 |

FOREIGN PATENT DOCUMENTS

| | | |
|---|---|---|
| EP | 1 245 783 | 2/2002 |
| FR | 2597150 | 4/1986 |
| GB | 2368079 | 10/2000 |
| WO | WO 97/05361 | 2/1997 |
| WO | WO 97/35093 | 9/1997 |
| WO | WO 00/57019 | 9/2000 |
| WO | WO 2001 20124 A1 | 3/2001 |
| WO | WO 01/90528 | 11/2001 |
| WO | WO 02/10549 | 2/2002 |

OTHER PUBLICATIONS

U.S. Appl. No. 10/644,749 to Livingstone, filed Aug. 21, 2003.*

Underbalanced Drilling; Nowsco, undated.

Nowsco/Downhole Systems: "Test Treat Test System Using a Concentric Coiled Tubing/DST Package": Hoyer, Fried & Sask, undated.

BlackMax Downhole Tools; An NQL Drilling Tools Inc. Company; Electro Magnetic Measurement While Drilling: Oil & Gas Application; EM=MWD, undated.

Logging While Drilling; http://www.odp.tamu.edu/publications/196_IR/chap_2/c2_.htm, undated.

Drilling and Formation Evaluation; Baker Hughes; www.bakerhughes.com/bakerhughes/products/well.htm, undated.

On Trak MWD System; Baker Hughes; www.bakerhughes.com/inteq/evaluation/ontrak/index.htm, undated.

PressTEQ Application Examples; Baker Hughes; www.bakerhughes.com/inteq/D&P/pressure/index.htm, undated.

Thruster Drilling System; Baker Hughes; www.bakerhughes.com/inteq/Drilling/thruster/index.htm, undated.

Coiled Tubing; Baker Hughes; Baker Oil Tools Coiled Tubing Solutions; www.bakerhughes.com/bot/coiled_tubing/index/htm, undated.

COLT Coil Tubing Drilling Bottom Hole Assembly; Antech Special Engineering Products; Coiled Tubing Downhole Tools, 2001.

U.S. Appl. No. 10/644,749, filed Aug. 21, 2003, by James Livingstone.

* cited by examiner

680

680

TWO STRING DRILLING SYSTEM

This application claims the benefit of U.S. Provisional Application No. 60/348,611, filed Jan. 17, 2002.

FIELD OF THE INVENTION

The present invention relates generally to a drilling method and assembly for exploration and production of oil, natural gas, coal bed methane, methane hydrates, and the like. More particularly, the present invention relates to a two string, or dual wall pipe drilling method and apparatus useful for reverse circulation drilling.

BACKGROUND OF THE INVENTION

Conventional drilling typically uses single wall jointed drill pipe with a drill bit attached at one end. Weighted drilling mud or fluid is pumped through a rotating drill pipe to drive the drill bit to drill a borehole. The drill cuttings and exhausted drilling mud and fluid are returned to the surface up the annulus between the drill pipe and the formation by using mud, fluids, gases or various combinations of each to create enough pressure to transport the cuttings out of the wellbore. Compressed air can also be used to drive a rotary drill bit or air hammer.

However, in order to transport the drill cuttings out of the wellbore, the hydrostatic head of the fluid column can often exceed the pressure of the formation being drilled. Therefore, the drilling mud or fluid can invade into the formation, causing significant damage to the formation, which ultimately results in loss of production. In addition, the drill cuttings themselves can cause damage to the formation as a result of the continued contact with the formation and the drill cuttings. Air drilling with a rotary drill bit or air hammer can also damage the formation by exceeding the formation pressure and by forcing the drill cuttings into the formation.

Underbalanced drilling technology has been developed to reduce the risk of formation damage due to the hydrostatic head of the fluid column, which uses a mud or fluid system that is not weighted. Hence, drill cutting can be removed without having the fluid column hydrostatic head exceed the formation being drilled resulting in less damage to the formation. Underbalanced drilling techniques typically use a commingled stream of liquid and gas such as nitrogen or carbon dioxide as the drilling fluid.

Nevertheless, even when using underbalanced drilling technology, there still is the possibility of damage to the formation. The drilling fluid and drill cuttings are still being returned to the surface via the annulus between the drill pipe and the formation. Hence, some damage to the formation may still occur due to the continued contact of the drilling cuttings and fluid with the formation. As well, underbalanced drilling is very expensive for wells with low or moderate production rates.

Formation damage is becoming a serious problem for exploration and production of unconventional petroleum resources. For example, conventional natural gas resources are buoyancy driven deposits with much higher formation pressures. Unconventional natural gas formations such as gas in low permeability or "tight" reservoirs, coal bed methane, and shale gases are not buoyancy driven accumulations and thus have much lower pressures. Therefore, such formations would damage much easier when using conventional oil and gas drilling technology.

The present invention reduces the amount of pressure which normally results when using air drilling, mud drilling, fluid drilling and underbalanced drilling by using a two string drilling system, thereby greatly reducing formation damage.

SUMMARY OF THE INVENTION

The present invention allows for the drilling of hydrocarbon formations in a less damaging, safe and economical manner. The present invention works particularly well in under-pressured hydrocarbon formations where existing underbalanced technologies may be too expensive, or fluids can damage the formation.

The present invention has a number of advantages over conventional drilling technologies in addition to virtually eliminating drilling damage to the formation. The invention reduces the accumulation of drill cuttings at the bottom of the wellbore; it allows for gas zones to be easily identified; and multi-zones of gas in shallow gas well bores can easily be identified without significant damage during drilling. Finally, the chances of a concentric drill string becoming stuck are greatly reduced due to the availability of three annuluses to circulate through.

The present invention can be used to drill an entire well or can be used in conjunction with conventional drilling technology. For example, the top portion of a hydrocarbon bearing formation can first be drilled using conventional drill pipe. The drill pipe can then be tripped out of the wellbore and the well casing cemented in place. The remainder of the well can then be drilled using the present two string drilling system.

A method for drilling a wellbore in a hydrocarbon formation is provided herein, comprising the steps of:

- providing a concentric drill string having an inner pipe, said inner pipe having an inside wall and an outside wall and situated within an outer pipe having an inside wall and an outside wall, said outside wall of said inner pipe and said inside wall of said outer pipe defining an annulus between the pipes;
- connecting a drilling means at the lower end of the concentric drill string;
- delivering drilling medium through one of said annulus or inner pipe for operating the drilling means to form a borehole and removing said drilling medium by extracting said drilling medium through said other of said annulus or inner pipe.

In a preferred embodiment, the drilling medium is delivered through the annulus and removed through the inner tube. Any drill cuttings, drilling medium and hydrocarbons will also be removed through the inner tube.

In a further preferred embodiment, the drilling medium is delivered through the inner tube and removed through the annulus. Any drill cuttings, drilling medium and hydrocarbons will also be removed through the annulus.

The method for drilling a wellbore can further comprise the step of providing a downhole flow control means positioned near the drilling means for preventing any flow of hydrocarbons from the inner pipe or the annulus or both to the surface when the need arises. Typically, the flow control means will operate to shut down the flow from both the inner pipe and the annulus when joints of concentric drill string are being added or removed.

In another preferred embodiment, the method for drilling a wellbore can further comprise the step of providing a surface flow control means for preventing any flow of hydrocarbons from the space between the outside wall of the outer pipe and the walls of the wellbore. This as well is important when adding or removing joints of concentric drill string.

In one preferred embodiment, the drilling means is a rotary drill bit or reciprocating air hammer and the drilling medium is compressed air. In another preferred embodiment the drilling means is a rotary drill bit, which uses a rotary table or top drive drilling system, and the drilling medium is drilling mud, drilling fluid, gases or various combinations of each.

The present invention further provides an apparatus for drilling a wellbore in hydrocarbon formations, comprising:

a concentric drill string having an inner pipe having an inside wall and an outside wall and an outer pipe having an inside wall and an outside wall, said outside wall of said inner pipe and said inside wall of said outer pipe defining an annulus between the pipes;

a drilling means at the lower end of said concentric drill string; and a drilling medium delivery means for delivering drilling medium through one of said annulus or inner pipe for operating the drilling means to form a borehole and for removing said drilling medium through said other of said annulus or inner tube.

The drilling medium can be air, drilling mud, drilling fluids, gases or various combinations of each.

In a preferred embodiment, the apparatus further comprises a downhole flow control means positioned near the drilling means for preventing flow of hydrocarbons from the inner pipe or the annulus or both to the surface of the wellbore.

In a further preferred embodiment, the apparatus further comprises a surface flow control means for preventing any flow of hydrocarbons from the space between the outside wall of the outer pipe and the walls of the wellbore.

DESCRIPTION OF THE PREFERRED EMBODIMENTS

Apparatus and methods of operation of that apparatus are disclosed herein in the preferred embodiments of the invention that allow for drilling a wellbore in hydrocarbon formations. From these preferred embodiments, a person skilled in the art can understand how this reverse circulation drilling process can be used safely in the oil and gas industry.

Figure 1:
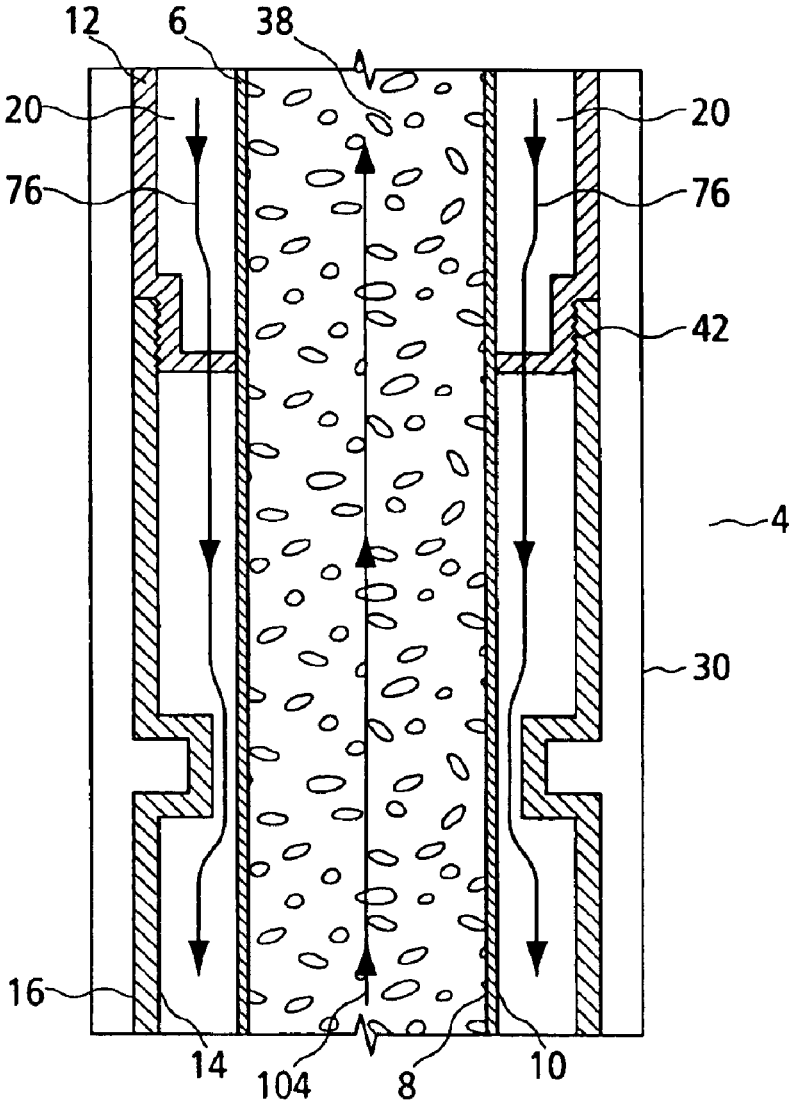
FIG. 1 is a vertical cross-section of a section of concentric drill string.

FIG. 1 is a vertical cross-section of a section of concentric drill string 4. Concentric drill string 4 comprises an inner pipe 6 having an inside wall 8 and an outside wall 10 and an outer pipe 12 having an inside wall 14 and an outside wall 16. The diameter of inner pipe 6 and outer pipe 12 can vary; in one embodiment of the invention, the outer diameter of the outer pipe 12 is 4½ inches and the outer diameter of the inner pipe 6 is 2½ inches. Joints of concentric drill string 4 are attached one to another by means such as threading means 42 to form a continuous drill string.

Concentric drill string annulus 20 is formed between the outside wall 10 of the inner pipe 6 and the inside wall 14 of the outer pipe 12. Drilling medium 76, for example, drilling mud, drilling fluid, compressed air or commingled mixtures of drilling mud, fluids and gases such as nitrogen and carbon dioxide, is pumped down concentric drill string annulus 20 and removed through the inner pipe. Drill cuttings 38 are removed through the inner pipe along with the exhausted drilling medium.

Figure 2:
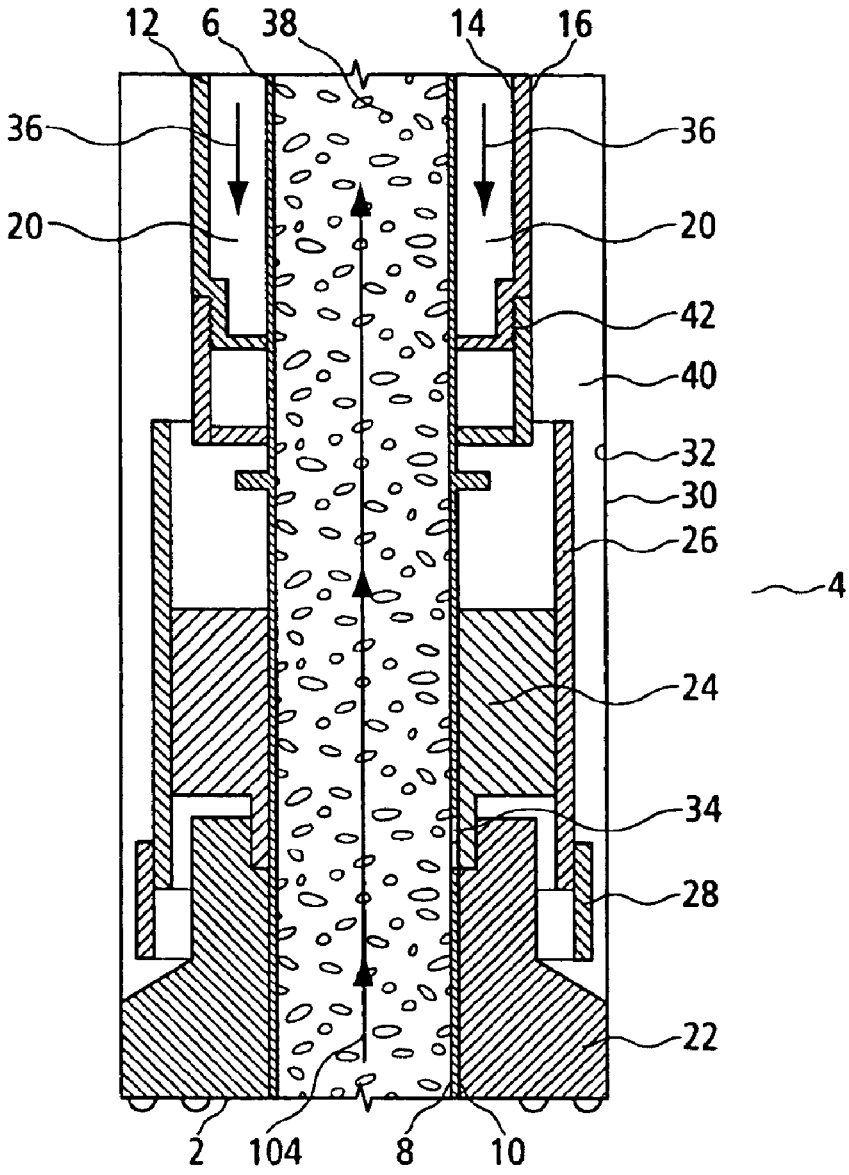
FIG. 2 is a vertical cross-section of a section of concentric drill string and drilling means thereto attached.

FIG. 2 is a vertical cross-section of the bottom portion of concentric drill string 4 showing drilling apparatus 2 attached to concentric drill string 4 by threading means 42. Drilling apparatus 2 as shown in this embodiment is a reciprocating rock drill operated by compressed air 36 traveling down concentric drill string annulus 20. The reciprocating rock drill comprises a wearing drill bit 22. Wearing drill bit 22 is connected to a reciprocating piston 24 moving within piston casing 26. Venturi 34, positioned between the reciprocating piston 24 and the inner pipe, directs and accelerates exhaust air from the reciprocating piston 24 to the inner pipe 6. The compressed air 36 is of sufficient velocity to pick up and carry all drill cuttings 38 to the surface of the well bore through the inner pipe 6.

Shroud 28 is located between the piston casing 26 and the formation 30 in relatively air tight and frictional engagement with the inner wellbore wall 32. Shroud 28 prevents compressed air 36 and drill cuttings from escaping up the formation annulus 40 between the outside wall 16 of the outer pipe 12 of the concentric drill string 4 and the inner wellbore wall 32.

In another embodiment of the present invention, compressed air can be pumped down the inner pipe 6 and the drill cuttings and exhaust compressed air carried to the surface of the well bore through concentric drill string annulus 20.

Reverse circulation drilling of the present invention can also use drilling mud or drilling fluids as well as air to power a rotary drill bit to cut the rock in the well bore. Powerful mud pumps push mud or fluids down concentric drill string annulus 20. Drill cuttings, drilling mud and fluids travel up the inner pipe 6 to surface of the wellbore where they are put into a mud tank or pit. In the alternative, drilling mud or drilling fluids can be pumped down the inner pipe 6 and the drilling mud or drilling fluids and drill cuttings travel up the concentric drill string annulus 20 to the surface of the wellbore.

Figure 3A:
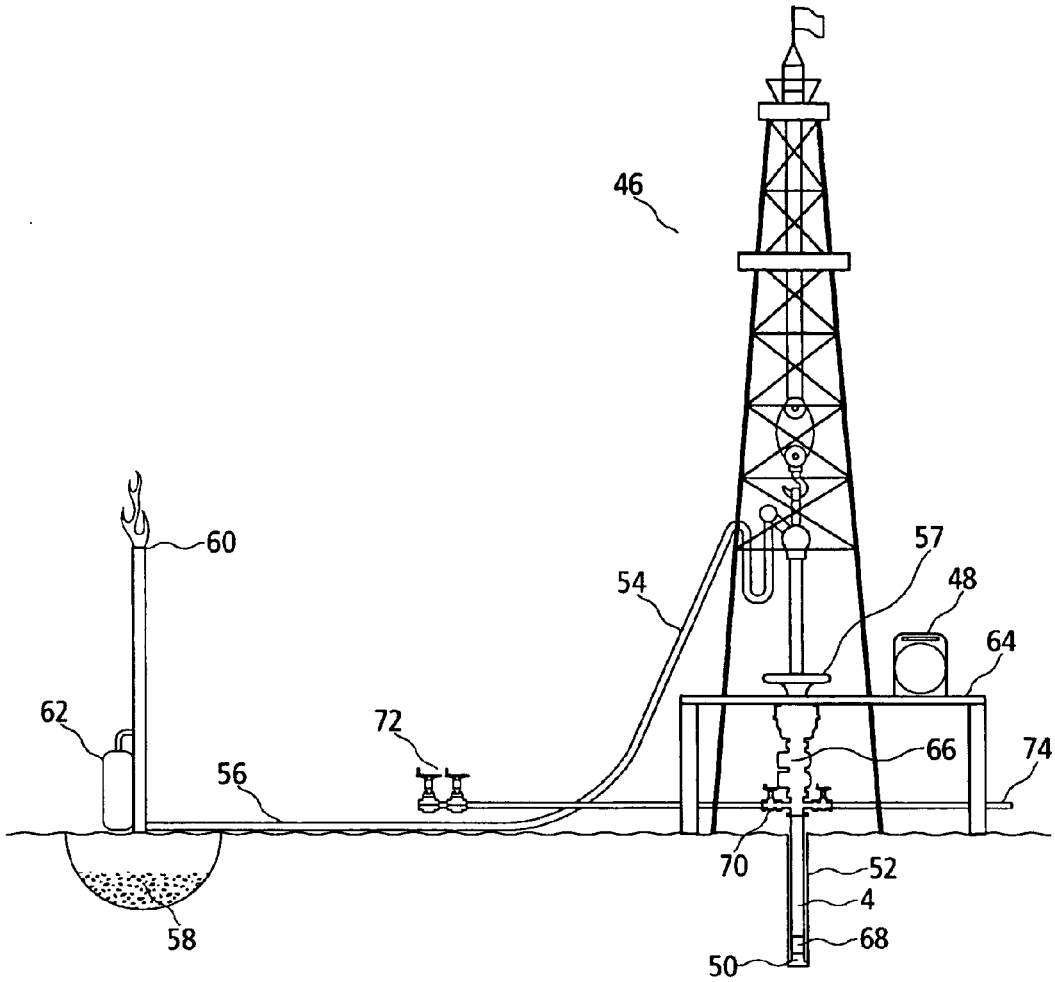
FIG. 3*a* is a general view showing a partial cross-section of the embodiment of the present invention as it is located in a drilling operation.
Figure 3B:
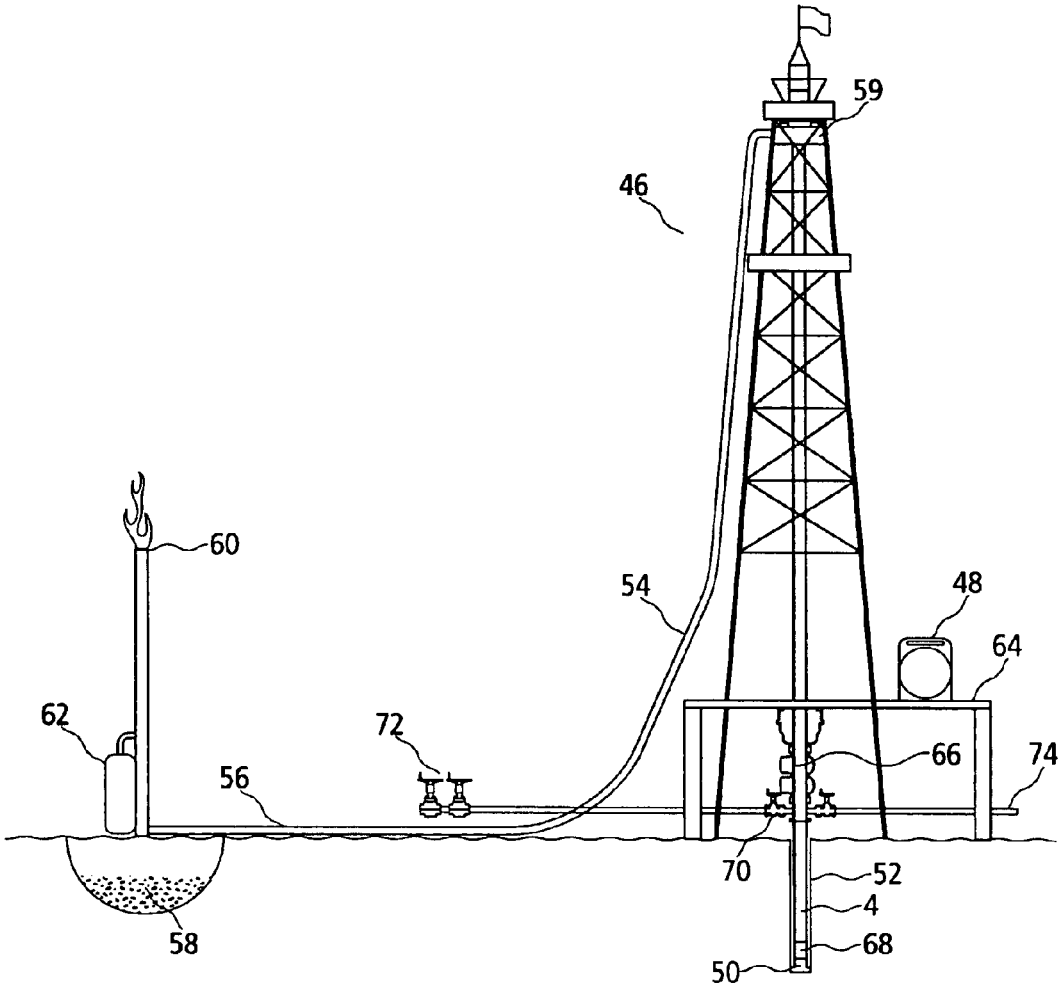
FIG. 3*b* is a general view showing a partial cross-section of one enbodiment of the present invention as it is located in a drilling operation.

FIGS. 3*a* and 3*b* shows a preferred embodiment of the present method and apparatus for safely. drilling a natural gas well or any well containing hydrocarbons using the concentric drilling string method. Drilling rig 46 comprises air compressor 48 which pumps compressed air down the concentric drill string annulus 20 of concentric drill string 4.

Drilling apparatus comprises air hammer 50 which is operated as described above to cut the rock in well bore 52. As air hammer 50 cuts through the rock in well bore 52, exhaust compressed air, drill cuttings and hydrocarbons from formation bearing zones are carried up inner pipe 6 as shown in FIGS. 1 and 2. Discharge line 54 carries the exhaust compressed air, drill cuttings and hydrocarbons produced from the well bore to blewie line 56. A suction type compressor (not shown) may be hooked up at the surface of the well bore to assist in lifting the drilling medium, drill cutting and hydrocarbons up the inner pipe.

Drill cuttings are deposited in pit 58. Hydrocarbons produced through blewie line 56 are flared through flare stack 60 by means of propane torch 62 to atmosphere. Propane torch 62 is kept lit at all times during the drilling operations to ensure that all hydrocarbons are kept at least 100 feet away from the drilling rig floor 64.

In FIG. 3*a* the drilling means 50 is rotated by rotary table 57 as is understood in the art.

In FIG. 3*b* the drilling means 50 is rotated by top drive 59 as is understood in the art.

Figure 4:
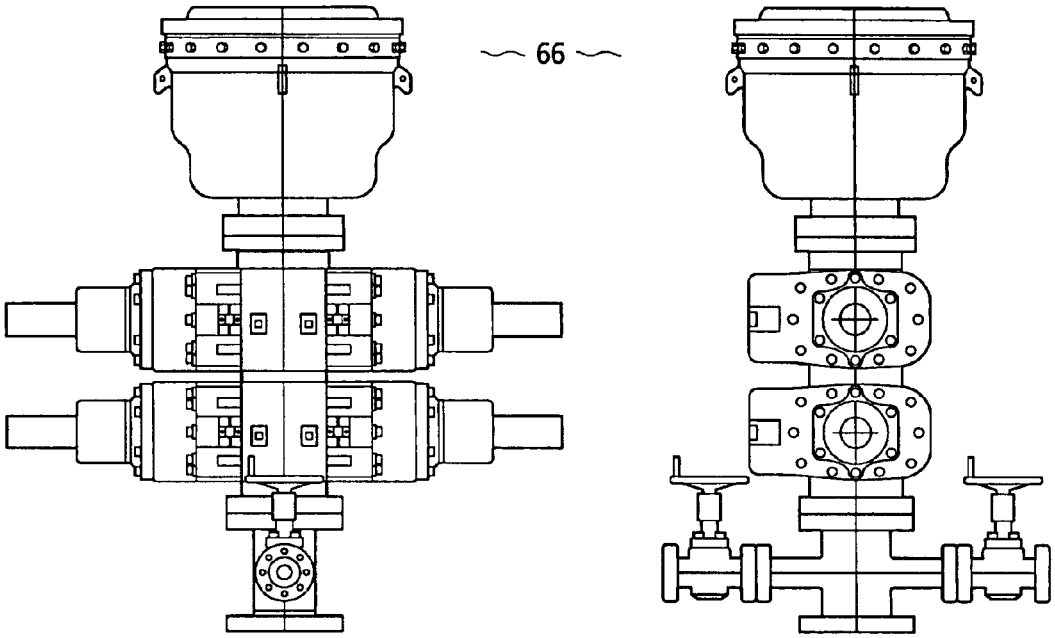
FIG 4 is a perspective of a surface flow control means.

A surface flow control means or surface annular blowout preventor 66 is used to prevent hydrocarbons from escaping from the formation annulus between the inner well bore wall and the outside wall of the outer pipe of the concentric drill string during certain operations such 88 tripping concentric drill string in or out of the well bore. An example of a suitable surface annular blowout preventor 66 is shown in FIG. 4. Other surface blowout preventors that can be used are taught in U.S. Pat. Nos. 5,044,602, 5,333,832 and 5,617,917, incorporated herein by reference.

It is preferable that the surface annular blowout preventor contain a circular rubber packing element (not shown) made of neoprene synthetic rubber or other suitable material that will allow the surface annular blowout preventor to seal around the shape of an object used downhole, for example, drill pipe, air hammer, drill bits, and other such drilling and logging tools.

Surface annular blowout preventor 66 is not equipped to control hydrocarbons flowing up the inside of concentric drill string 4, however. Therefore, a second downhole flow control means or blowout preventor 68 Is used to prevent hydrocarbons from coming up inner pipe 6 and concentric drill string annulus 20. For example, when concentric drill string 4 is tripped out of the well bore, downhole flow control means 68 should be in the closed position to ensure maximum safety. This allows for the safe removal of all joints of concentric drill string from the well bore without hydrocarbons being present on the drill rig floor 64. The downhole flow control means 68 is preferably attached at or near the drilling apparatus for maximum effectiveness.

Figure 5:
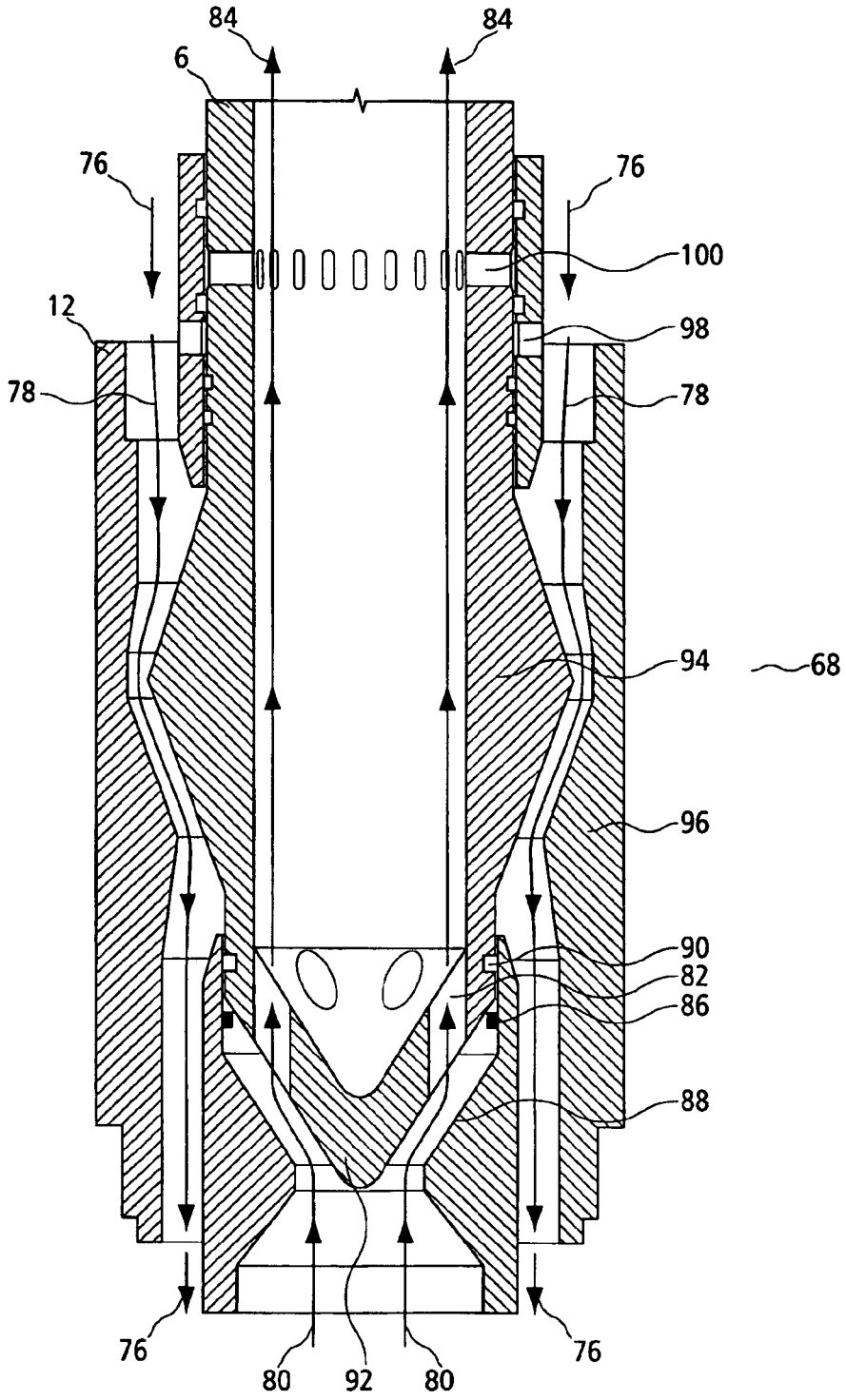
FIG. 5 is a vertical cross-section of one embodiment of a downhole flow control means.

One embodiment of downhole flow control means 68 is shown in greater detail in FIG. 5. This figure shows downhole flow control means 68 in the open position, where drilling medium 76 can flow down concentric drill string annulus 20 and in communication with flow path 78. Drilling medium 76 is allowed to continue through flow control means 68 and communicate with and power the air hammer. Exhausted compressed air, drill cuttings and hydrocarbons can flow freely from the reverse circulation of the air hammer up flow path 80. Exhausted compressed air, drill cuttings and hydrocarbons then flow through ports 82 which allow for communication with the inner pipe 6 through flow path 84.

When desired, flow paths 78 and 80 can be closed by axially moving inner pipe a downward relative to outer pipe 12, or conversely moving outer pipe 12 upward relative to inner pipe 6. Inner pipe 6 can be locked into place relative to outer string 12. A friction ring 86 on surface 88 aligns with recess 90 on surface 92 to lock the inner pipe 6 and outer pipe 12 together until opened again by reversing the movement. When in the closed position, surface 92 is forced against surface 88 to close off flow path 80. Similarly, surface 94 is forced against surface 96 to seal off flow path 78. Applying axial tension between the two pipes reverses the procedure, and restores flow through flow path 78 and 80.

An optional feature of flow control means 68 is to provide a plurality of offsetting ports 98 and 100 which are offset while the downhole flow control means is open, but are aligned when the downhole flow control means is in the closed position. The alignment of the plurality of ports 98 and 100 provide a direct flow path between flow paths 78 and 80. This feature would allow for continued circulation through the inner pipe 6 and the concentric drill string annulus 20 for the purpose of continuous removal of drill cutting from the concentric drill string while the downhole flow control means 68 is in the closed position.

It should be noted that while downhole flow control means 68 has been described in the context of air drilling, this downhole flow control means can also be used when drilling with drilling mud, drilling fluids, gas or various mixtures of the three. However, when the drilling medium used is drilling mud or drilling fluid, an alternate downhole flow control means can be used which only shuts down flow through the inner pipe 6. This is because the hydrocarbons would likely not be able to escape through the drilling mud or drilling fluid remaining in concentric drill string annulus 20. One embodiment of such a downhole flow control means is shown in FIGS. 6*a* and 6*b*, FIGS. 7*a* and 7*b*, FIG. 8 and FIG. 9. This flow control means is further described in more detail in U.S. patent application Ser. No. 10/321,087, incorporated herein by reference.

Figure 6A:
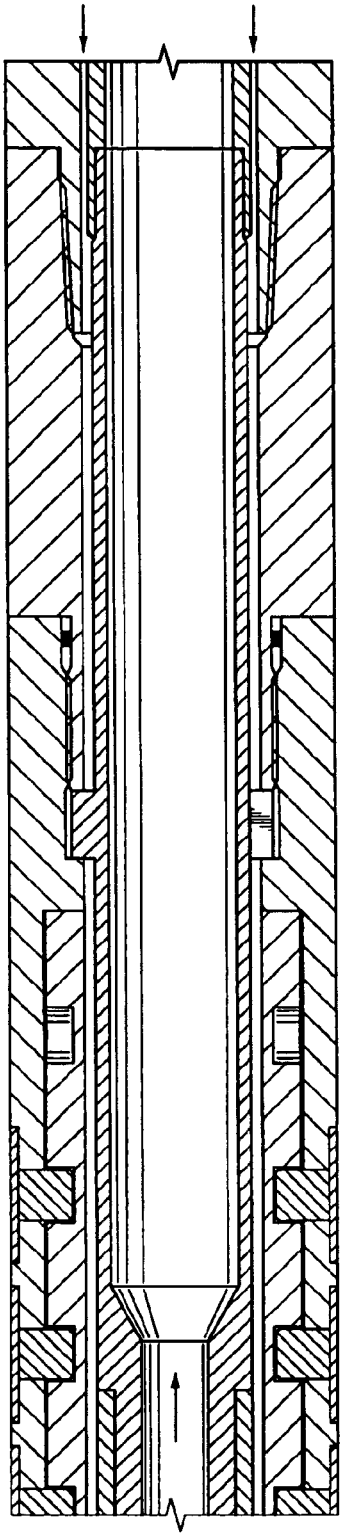
FIGS. 6*a* and 6*b* show a vertical cross-section of the top portion and bottom portion, respectively, of another embodiment of a downhole flow control means in the open position.
Figure 6B:
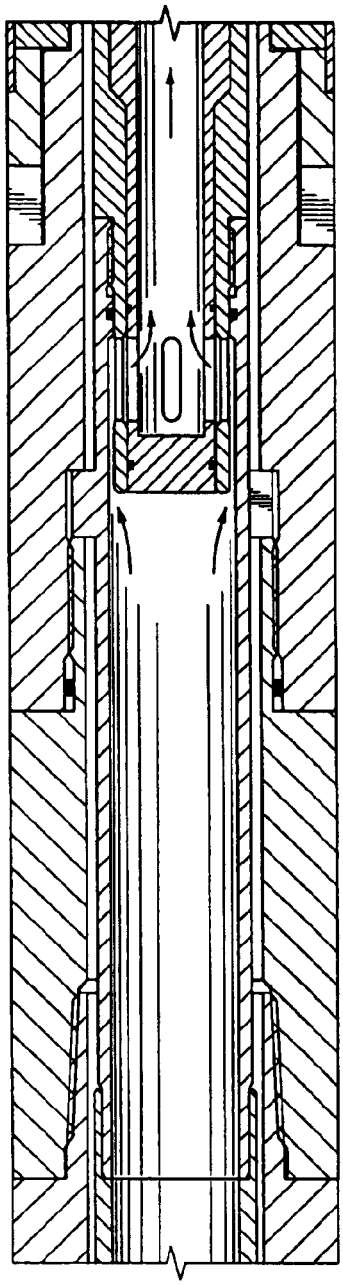
Figure 7A:
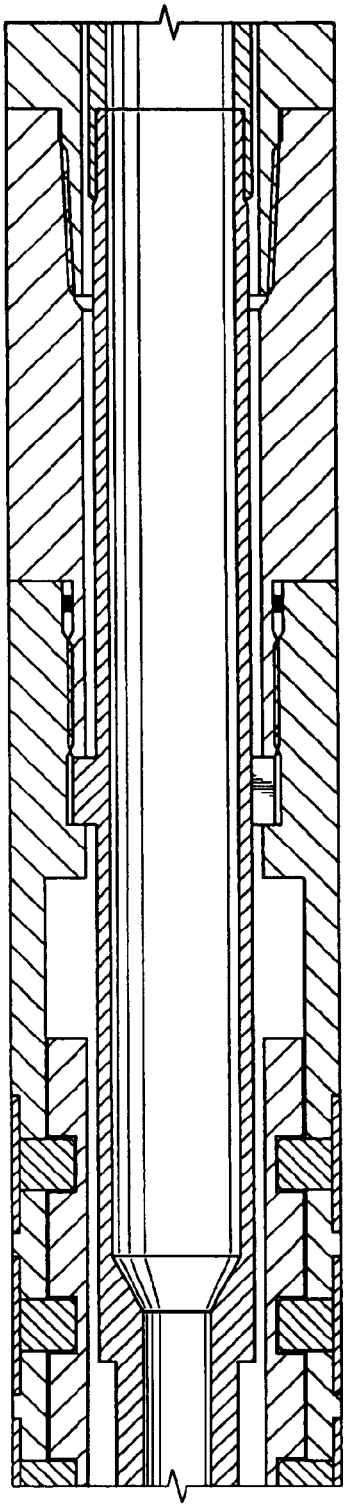
FIGS. 7*a* and 7*b* show a vertical cross-section of the top portion and bottom portion, respectively, of the downhole flow control means shown in 6*a* and 6*b* in the closed position.
Figure 7B:
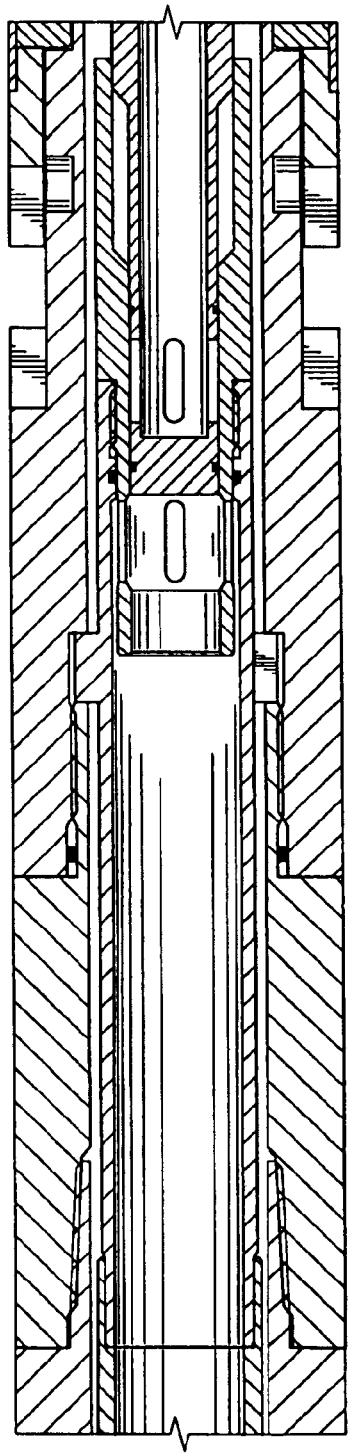
Figure 8:
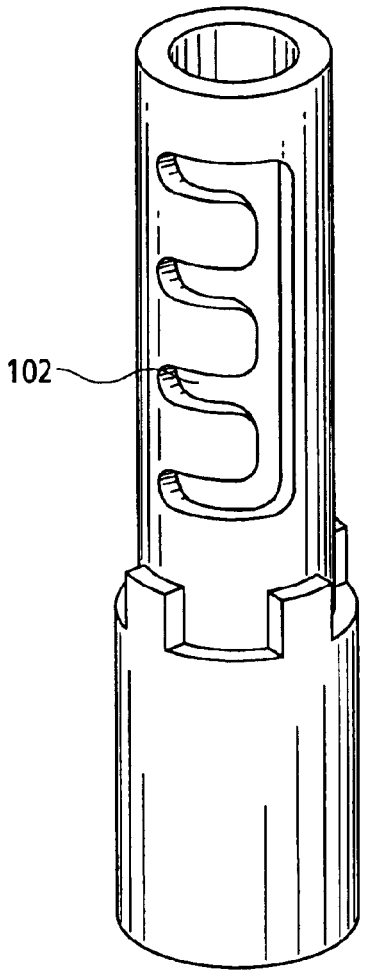
FIG. 8 is a perspective of the plurality of flow through slots of the downhole flow control means shown in 6*a* and 6*b* in the open position.
Figure 9:
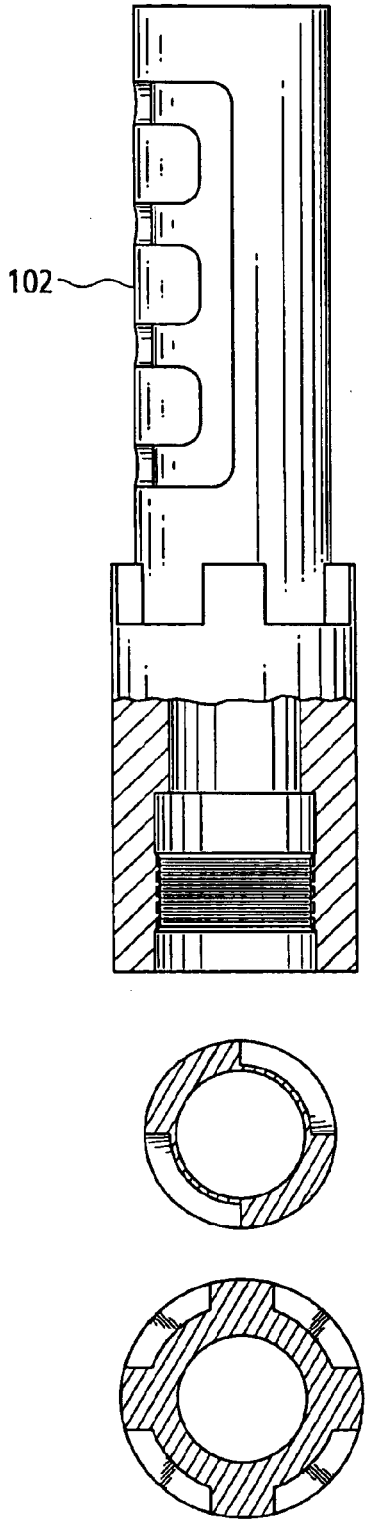
FIG. 9 is a perspective of the plurality of flow through slots of the downhole flow control means shown in 7*a* and 7*b* in the closed position.

FIGS. 6*a* and 6*b* show the downhole flow control means 680 in the open position, where exhausted compressed air, drilling mud or fluids, drill cuttings and hydrocarbons can flow freely up the concentric drill string attached thereto to the surface of the well bore. FIGS. 7*a* and 7*b* show the downhole flow control means 680 in the closed position. To place the downhole flow control means 680 in the closed position, the concentric drill string must be resting solidly on the bottom of the well bore. The entire concentric drill string is rotated three quarters of one turn to the left. The mechanical turning to left direction closes a plurality of flow through slots 102, shown in FIG. 8 in the open position. The closed position of the downhole flow control means 480 is shown in FIG. 9 where the plurality of flow through slots 102 is in the closed position.

To open the downhole flow control means 480, the downhole flow control means 480 is place solidly on the bottom of the well bore and the entire concentric drill string 480 is rotated back to the right, three quarters of one turn. This will restore the plurality of flow through slots 102 to the open position.

It often occurs during drilling operations that a "kick" or overpressure situation occurs down in the well bore. If this occurs, both the surface annular blowout preventor 66 and the downhole flow control means 68 would be put into the closed position. Diverter line 70 and manifold choke system 72 would be used to reduce the pressure in the well bore. If this fails to reduce the pressure in the well bore then drilling mud or fluid could be pumped down the kill line 74 to regain control of the well.

While various embodiments in accordance with the present invention have been shown and described, it is understood that the same is not limited thereto, but is susceptible of numerous changes and modifications as known to those skilled in the art, and therefore the present invention is not to be limited to the details shown and described herein, but intend to cover all such changes and modifications as are encompassed by the scope of the appended claims.

I claim:

1. A method for drilling a well bore in a hydrocarbon formation, comprising:

providing a concentric drill string having an inner pipe, said inner pipe having an inside wall and an outside wall and situated within an outer pipe having an inside wall and an outside wall, said outside wall of said inner pipe and said inside wall of said outer pipe defining an annulus between the pipes;

forming a borehole in said hydrocarbon formation with a drilling means connected at the lower end of the concentric drill string;

delivering drilling medium through one of said annulus or inner pipe to the drilling means for entraining drill cuttings in said borehole;

extracting said drilling medium and entrained drill cuttings through said other of said annulus or inner pipe; and providing a downhole flow control means positioned at or near the drilling means for preventing flow of hydrocarbons from the inner pipe or the annulus or both to the surface of the well bore.

2. The method of claim 1 wherein the drilling medium is delivered through the annulus and extracted through the inner tube.

3. The method in claim 1 wherein the drilling medium is delivered through the inner tube and extracted through the annulus.

4. The method in claim 1 further comprising providing a surface flow control means positioned at or near the surface of the well bore for preventing flow of hydrocarbons from a space between the outside wall of the outer pipe and a wall of the well bore.

5. The method of claim 4, said surface flow control means further comprising a discharging means, said method further comprising removing said drilling medium and said entrained drilling cuttings through said discharging means from said well bore.

6. The method of claim 5 wherein said discharging means further comprises a flare means for flaring hydrocarbons produced from the well bore.

7. The method of claim 1 wherein drilling medium comprises air and drilling means comprises a reciprocating air hammer.

8. The method of claim 1 wherein drilling medium comprises air and drilling means comprises a rotary drill bit operated by a rotary table or top drive drilling system.

9. The method of claim 1 wherein said drilling medium is selected from the group comprising drilling mud, drilling fluid and a mixture of drilling fluid and gas and said drilling means comprises a drill bit operated by a rotary table or top drive drilling system.

10. The method of claim 1, said concentric drill string further comprising a venturi, said method further comprising accelerating said drilling medium through said venturi so as to facilitate removal of said drilling medium and entrained drill cuttings from the concentric drill string.

11. The method in claim 1 further comprising providing a shroud means positioned between the outside wall of the outer pipe and a wall of the well bore for preventing release of drilling medium or entrained drill cuttings or both outside the concentric drill pipe and into the formation.

12. The method of claim 1 further comprising providing a suction type compressor for extracting said drilling medium and entrained drill cuttings through said annulus or inner pipe.

13. An apparatus for drilling a well bore in a hydrocarbon formation, comprising:

a concentric drill string having an inner pipe, said inner pipe having an inside wall and an outside and situated within an outer pipe having an inside wall and an outside wall, said outside wall of said inner pipe and said inside wall of said outer pipe defining an annulus between the pipes;

a drilling means attached to the lower end of the concentric drill string for forming a borehole;

a drilling medium delivery means for delivering drilling medium through one of said annulus or inner pipe to the drilling means for entraining and removing drill cuttings through said other of said annulus or inner pipe; and a downhole flow control means positioned at or near the drilling means for preventing flow of hydrocarbons from the inner pipe or the annulus or both to the surface of the well bore.

14. The apparatus of claim 13 further comprising a surface flow control means positioned at or near the surface of the well bore for preventing flow of hydrocarbons from a space between the outside wall of the outer pipe and a wall of the borehole.

15. The apparatus of claim 14 further comprising a discharging means attached to said surface flow control means for discharging said drilling medium and said entrained drilling cuttings from the well bore.

16. The apparatus of claim 15 further comprising a flare means attached to said discharging means for flaring hydrocarbons produced from the well bore.

17. The apparatus of claim 13 wherein drilling medium is selected from the group comprising drilling mud, drilling fluid and a mixture of drilling fluid and gas and said drilling means comprises a drill bit operated by a rotary table or top drive system.

18. The apparatus of claim 13, wherein the concentric drill string further comprising a venturi for accelerating said drilling medium so as to facilitate removal of said drilling medium and entrained drill cuttings from the concentric drill string.

19. The apparatus of claim 13 further comprising a shroud means positioned between the outside wall of the outer pipe and a wall of the well bore for preventing release of drilling medium or entrained drill cuttings or both outside the concentric drill pipe and into the formation.

20. The apparatus of claim 13 further comprising a suction type compressor positioned at or near the top of the well bore for extracting said drilling medium and entrained drill cuttings through said annulus or inner pipe.

21. The apparatus of claim 13 wherein drilling medium comprises air and said drilling means comprises a reciprocating air hammer.

22. The apparatus of claim 13 wherein drilling medium comprises air and said drilling means comprises a rotary bit operated by a rotary table or top drive system.

23. A method for drilling a well bore in a hydrocarbon formation, comprising:

providing a concentric drill string having an inner pipe, said inner pipe having an inside wall and an outside wall and situated within an outer pipe having an inside wall and an outside wall, said outside wall of said inner pipe and said inside wall of said outer pipe defining an annulus between the pipes;

forming a borehole in said hydrocarbon formation with a drilling means connected at the lower end of the concentric drill string;

delivering drilling medium through one of said annulus or inner pipe to the drilling means for entraining drill cuttings in said borehole;

extracting said drilling medium and entrained drill cuttings through said other of said annulus or inner pipe; and providing a surface flow control means positioned at or near the surface of the well bore for preventing flow of hydrocarbons from a space between the outside wall of the outer pipe and a wall of the well bore.

24. The method of claim 23 wherein the drilling medium is delivered through the annulus and extracted through the inner tube.

25. The method in claim 23 wherein the drilling medium is delivered through the inner tube and extracted through the annulus.

26. The method of claim 23, said surface flow control means further comprising a discharging means, said method further comprising removing said drilling medium and said entrained drilling cuttings through said discharging means from said well bore.

27. The method of claim 26 wherein said discharging means comprises a flare means for flaring hydrocarbons produced from the well bore.

28. The method of claim 23, said the concentric drill string further comprising a venturi, said method further comprising accelerating said drilling medium through said venturi so as to facilitate removal of said drilling medium and entrained drill cuttings from the concentric drill string.

29. The method in claim 23 further comprising providing a shroud means positioned between the outside wall of the outer pipe and a wall of the well bore for preventing release of drilling medium or entrained drill cuttings or both outside the concentric drill pipe and into the formation.

30. The method of claim 23 further comprising providing a suction type compressor for extracting said drilling medium and entrained drill cuttings through said annulus or inner pipe.

31. A method for drilling a well bore in a hydrocarbon formation, comprising:

providing a concentric drill string having an inner pipe, said inner pipe having an inside wall and an outside wall and situated within an outer pipe having an inside wall and an outside wall, said outside wall of said inner pipe and said inside wall of said outer pipe defining an annulus between the pipes;

forming a borehole in said hydrocarbon formation with a drilling means connected at the lower end of the concentric drill string;

delivering drilling medium through one of said annulus or inner pipe to the drilling means for entraining drill cuttings in said borehole;

extracting said drilling medium and entrained drill cuttings through said other of said annulus or inner pipe; and providing a shroud means positioned between the outside wall of the outer pipe and a wall of the well bore for preventing release of drilling medium or entrained drill cuttings or both outside the concentric drill pipe and into the formation.

32. The method of claim 31 wherein the drilling medium is delivered through the annulus and extracted through the inner tube.

33. The method in claim 31 wherein the drilling medium is delivered through the inner tube and extracted through the annulus.

34. An apparatus for drilling a well bore in a hydrocarbon formation, comprising:

a concentric drill string having an inner pipe, said inner pipe having an inside wall and an outside and situated within an outer pipe having an inside wall and an outside wall, said outside wall of said inner pipe and said inside wall of said outer pipe defining an annulus between the pipes;

a drilling means attached to the lower end of the concentric drill string for forming a borehole;

a drilling medium delivery means for delivering drilling medium through one of said annulus or inner pipe to the drilling means for entraining and removing drill cuttings through said other of said annulus or inner pipe; and a surface flow control means positioned at or near the surface of the well bore for preventing flow of hydrocarbons from a space between the outside wall of the outer pipe and a wall of the borehole.

35. The apparatus of claim 34 further comprising a discharging means attached to said surface flow control means for discharging said drilling medium and said entrained drilling cuttings from the well bore.

36. The apparatus of claim 35 further comprising a flare means attached to said discharging means for flaring hydrocarbons produced from the well bore.

37. The apparatus of claim 34 wherein the concentric drill string further comprises a venturi for accelerating said drilling medium so as to facilitate removal of said drilling medium and entrained drill cuttings from the concentric drill string.

38. The apparatus of claim 34 further comprising a shroud means positioned between the outside wall of the outer pipe and a wall of the well bore for preventing release of drilling medium or entrained drill cuttings or both outside the concentric drill pipe and into the formation.

39. The apparatus of claim 34 further comprising a suction type compressor positioned at or near the top of the well bore for extracting said drilling medium through said annulus or inner pipe.

40. An apparatus for drilling a well bore in a hydrocarbon formation, comprising:

a concentric drill string having an inner pipe, said inner pipe having an inside wall and an outside and situated within an outer pipe having an inside wall and an outside wall, said outside wall of said inner pipe and said inside wall of said outer pipe defining an annulus between the pipes;

a drilling means attached to the lower end of the concentric drill string for forming a borehole;

a drilling medium delivery means for delivering drilling medium through one of said annulus or inner pipe to the drilling means for entraining and removing drill cuttings through said other of said annulus or inner pipe; and a shroud means positioned between the outside wall of the outer pipe and a wall of the well bore for preventing release of drilling medium or entrained drill cuttings or both outside the concentric drill pipe and into the formation.

* * * * *